US006260279B1

(12) United States Patent
Apolinski et al.

(10) Patent No.: US 6,260,279 B1
(45) Date of Patent: Jul. 17, 2001

(54) DEVICE FOR CUTTING WORKPIECES

(75) Inventors: Edmund Apolinski, Chicago; David Daniels, Lake Villa, both of IL (US); Winfried Ebert, Weibern (DE)

(73) Assignee: Wolfcraft GmbH, Kempenich (DE)

( * ) Notice: Subject to any disclaimer, the term of this patent is extended or adjusted under 35 U.S.C. 154(b) by 0 days.

(21) Appl. No.: 09/513,570

(22) Filed: Feb. 25, 2000

(30) Foreign Application Priority Data

Feb. 25, 1999 (DE) ..... 199 08 153

(51) Int. Cl.[7] ..... B26B 13/04; B26B 13/12
(52) U.S. Cl. ..... 30/341; 30/125; 30/193
(58) Field of Search ..... 30/125, 260, 262, 30/193, 341; 7/127–131; 81/427.5

(56) References Cited

U.S. PATENT DOCUMENTS 3,772,783 * 11/1973 Averitt ..... 30/260 X
3,872,591 * 3/1975 Quenot ..... 30/125 X
5,625,952 * 5/1997 Thomas ..... 30/262
5,774,991 * 7/1998 Shi ..... 30/262

FOREIGN PATENT DOCUMENTS

WO 90/11164 * 10/1990 (WO) ..... 7/132

* cited by examiner

*Primary Examiner*—Douglas D. Watts
(74) *Attorney, Agent, or Firm*—Schiff Hardin & Waite

(57) ABSTRACT

A device for cutting workpieces is in the form of pliers. One plier arm carries on an operating-end section an interchangeable blade. The blade can be moved toward and engages against an anvil of the operating-end section of the other plier arm by moving the plier arms toward one another. In order to improve the handling of such a cutting device, each plier arm includes a handle section. One of the two handle sections forms a selectively closeable storage chamber for storing spare blades. The chamber is in a core part of one of the plier arms and is covered and closed by a handle shell.

11 Claims, 4 Drawing Sheets

VIII
VIII 1
2
3
4
5
6
7
8
9
10
11
12
14
15
16
17
18
19
20
21
27
28
29
30
19,20

DEVICE FOR CUTTING WORKPIECES

BACKGROUND OF THE INVENTION

The invention generally relates to a device for cutting workpieces, and more particularly to a device in the form of pliers, one plier arm carrying an interchangeable blade which, when moved towards the other plier arm, engages against an anvil of the other plier arm.

Such a device is disclosed in U.S. Pat. No. 5,673,487. The known plier-like device has a blade-holder which secures the blade by means of a jaw which can be unscrewed. In this jaw mount, the blade can rotate slightly so that it can come into linear abutment against the anvil. The blade can be exchanged for a spare blade which is to be stored in a separate spare-blade container.

SUMMARY OF THE INVENTION

One object of the present invention is to provide a device for cutting workpieces that has improved handling characteristics. Another object of the present invention is to provide such a device that is relatively simple and straight forward to manufacture and utilize. A further object of the present invention is to provide a device for cutting workpieces in the form of pliers wherein the spare blades can be stored in one plier arm of the device.

These and other objects, features and advantages of the present invention are provided by a device for cutting workpieces that includes a pair of plier arms pivotally movable relative to one another. Each plier arm of the device includes a handle section wherein the two handle sections are movable relative to one another in order to operate the device. Each plier arm also includes an operating-end section opposite the respective handle section. One of the operating-end sections has an interchangeable blade mounted thereon that engages or abuts against an anvil carried on the operating-end section of the other plier arm. One of the two handle sections forms a closed, but openable chamber for accommodating spare blades.

In one embodiment of the invention, the openable chamber is in a core part of the respective plier arm and is kept closed by a pivotable handle shell. The handle shell can have a U-shaped formation and can be pivoted outward. In one embodiment, the handle shell preferably pivots open in an outward direction from the core part. The handle shell can also be pivoted closed toward the core part by the user's hand.

In one embodiment, a pivot pin of the handle shell is mounted in the region of the pivot joint of the two plier arms, so that the chamber does not open during the normal, intended use of the tool.

In one embodiment, the handle shell which engages over the chamber is of a length that corresponds to the entire handle section.

In one embodiment the chamber has a rear through-passage opening, so that the spare blades can be removed more easily.

In one embodiment, the chamber has a depth that allows it to receive a multiplicity of spare blades.

In one embodiment, the two plier arms are preferably formed from a bent, punched sheet-metal core part and an injection molded handle section part. It is also possible for the two plier arms to be mounted to one another by a plastic material pin.

The two plier arms thus advantageously define a core part, and these each carry, on the handle section, a molded handle shell which may be of U-shaped configuration. The core parts and the handle shells are preferably connected to one another by a positive locking mechanism.

In another embodiment of the invention, the two plier arms can be locked to one another in their closed position. A latching means is provided for this purpose. The latching means is associated with a narrow side of the handle sections, on the pivot-point side. A locking member projects out of the narrow side of one handle section and can be positioned by pivoting or pushing against a latching shoulder of the other plier arm. The locking member is preferably on the plier arm that carries the anvil and can be actuated by the thumb of the operating hand.

In one embodiment of the tool according to the invention, one of the plier arms which is formed as a sheet-metal part, has an opening in a pivot or bearing region. The opening forms two cheeks so that the other plier arm can be inserted into the opening. Pins project laterally from the other plier arm and form bearing pins which can pass into openings associated with the cheeks. That section of the blade-carrying plier arm which is rotatably mounted within these cheeks forms the latching shoulder, so that latching can take place in a concealed position.

BRIEF DESCRIPTION OF THE DRAWINGS

An exemplary embodiment of the invention is explained in detail hereinbelow with reference to accompanying drawings, in which:

FIG. 6 shows the device according to FIG. 1 in an open position;

FIG. 7 shows the device according to FIG. 6 with the chamber open;

DETAILED DESCRIPTION OF THE PREFERRED EMBODIMENTS

Figures 1, 2, 3, 4, 5:
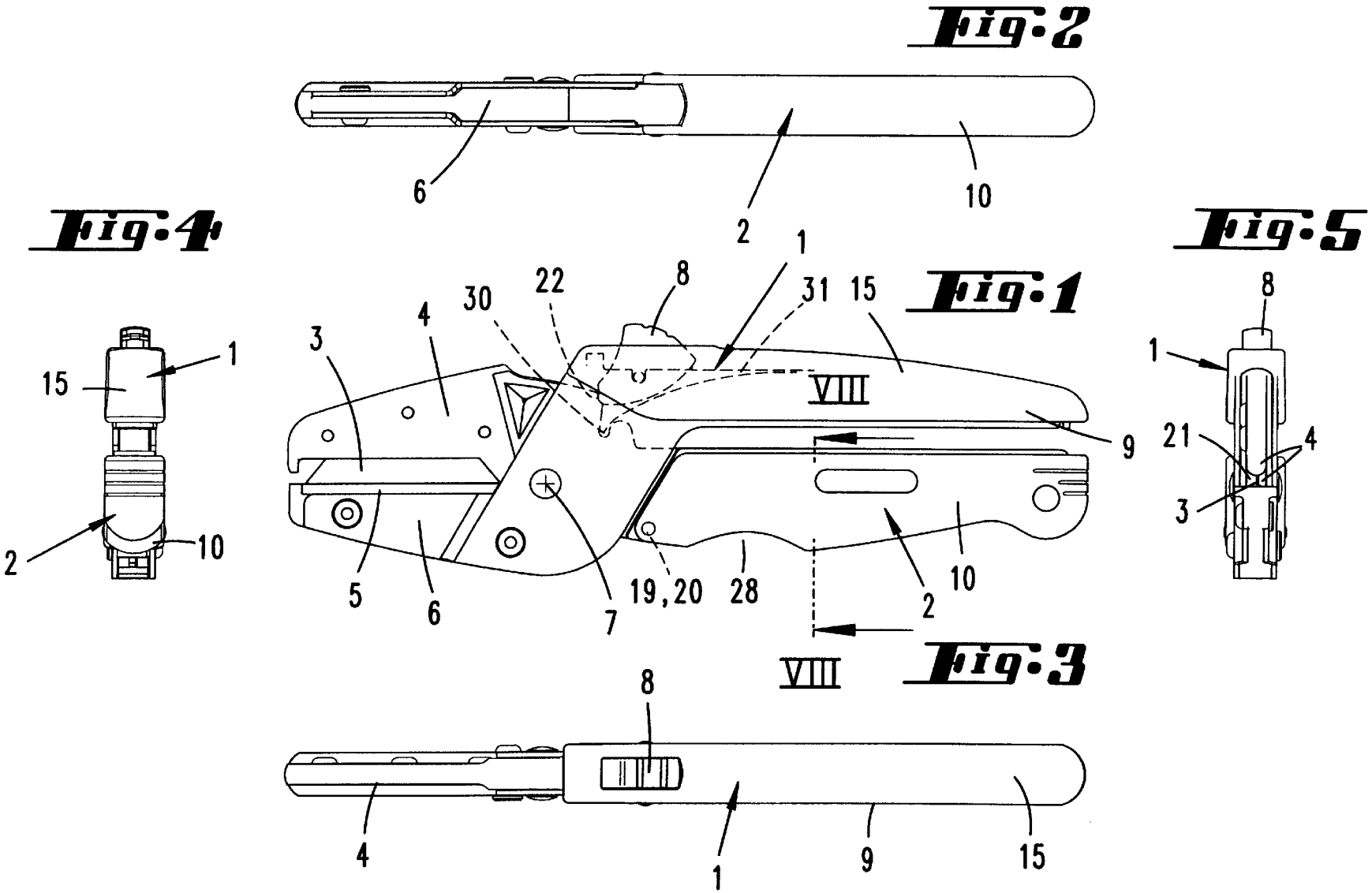
FIG. 1 shows a side view of a device constructed in accordance with one embodiment of the invention.
FIG. 2 shows a bottom view of the device of FIG. 1.
FIG. 3 shows a plan view of the device of FIG. 1.
FIG. 4 shows a rear view of the device of FIG. 1.
FIG. 5 shows a front view of the device of FIG. 1.
Figures 4, 5, 8:
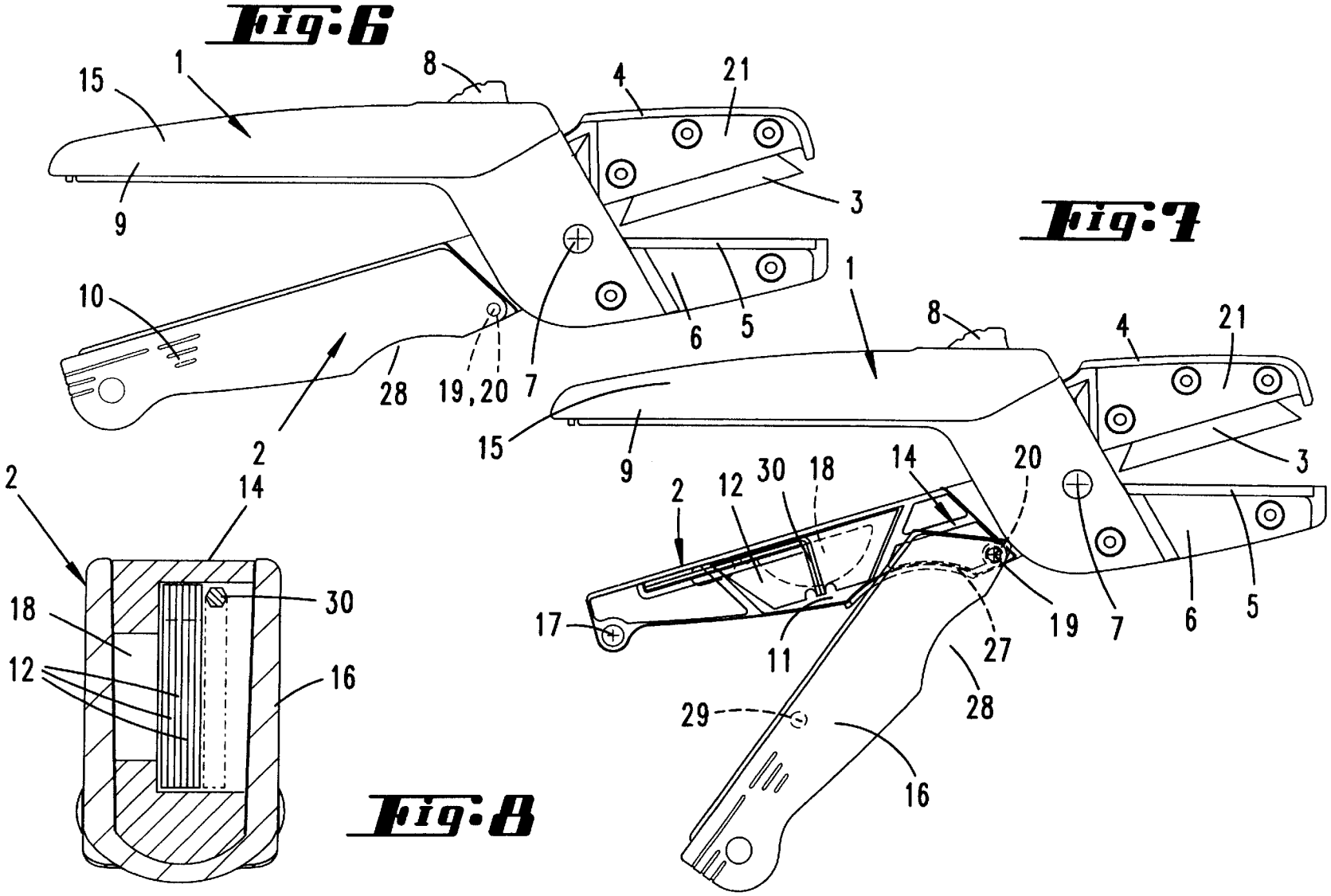
FIG. 8 shows an enlarged illustration of a section along line VIII—VIII of FIG. 1.
Figure 9:
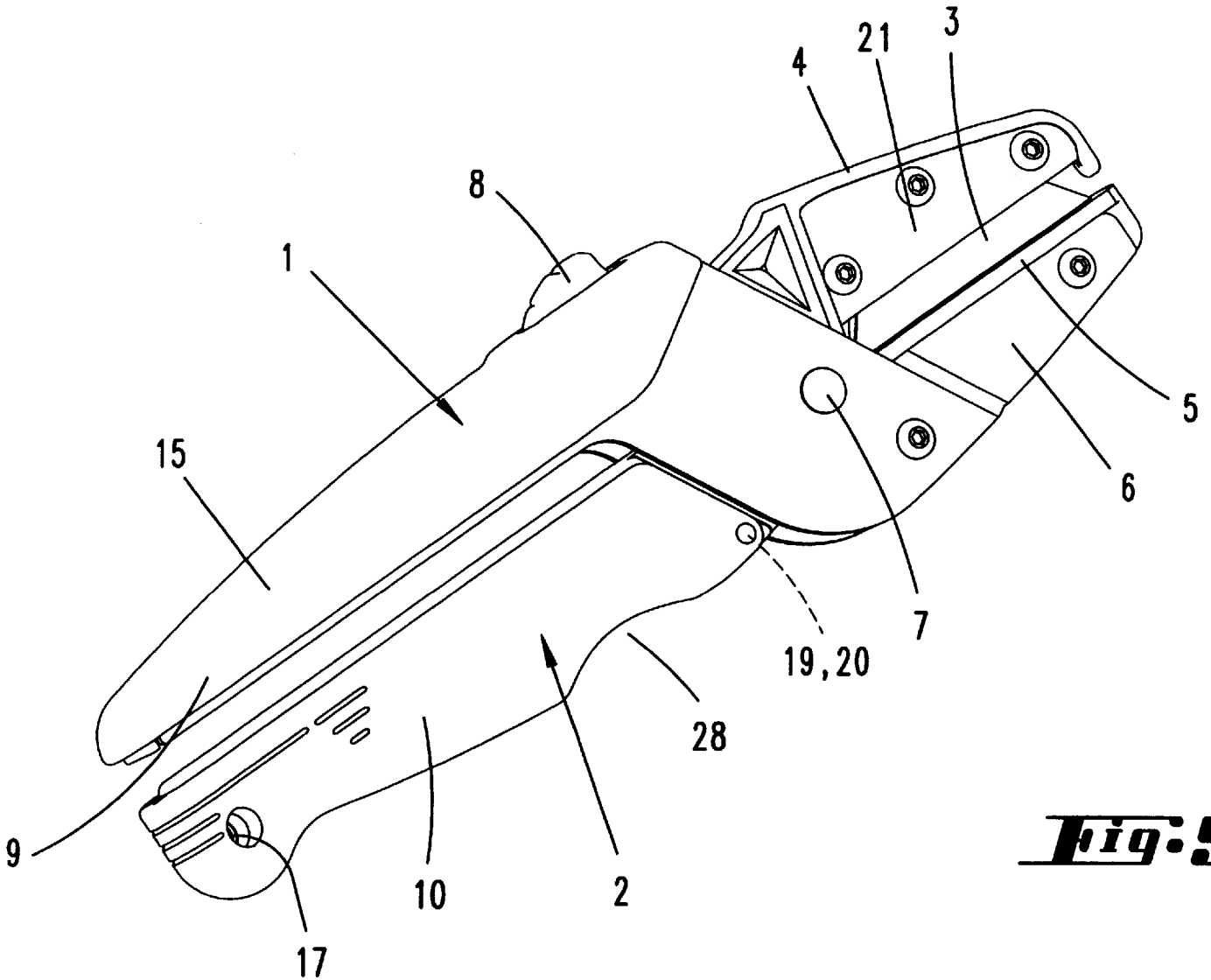
FIG. 9 shows a side view of the device opposite that side shown in FIG. 1.
Figure 10:
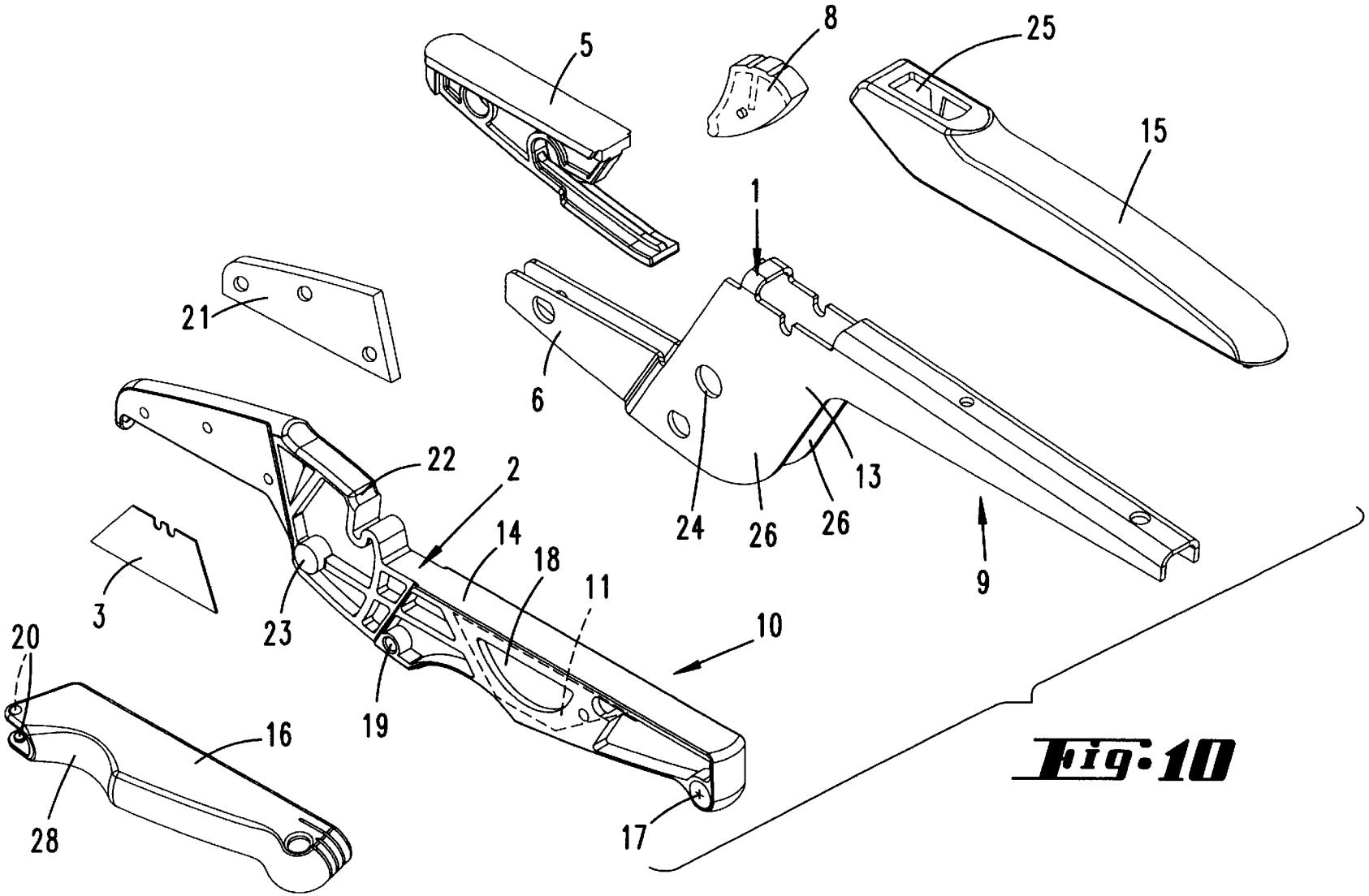
FIG. 10 shows an exploded perspective view of the device of FIG. 1.

The device as best shown in FIGS. 1–5 has two plier arms 1 and 2 which are connected to one another by a pivot point 7 and may thus be pivoted with respect to one another. The two plier arms are each generally in the form of a Z-shape overall, the bearing being located in the region of the crossbar of the Z. The two legs of the Z-shape of each plier arm form either an operating end section or a handle section.

An operating-end section of the plier arm 2 is formed as a blade-holder 4. The blade-holder 4 carries a trapezoidal blade 3 which is held in a manner known to those skilled in the art between the blade-holder 4 and a screw-on jaw 21. The blade is supported on a protrusion between the holder 4 and jaw 21 so that it can be pivoted slightly in order to be able to come into linear abutment against an anvil 5 (see U.S. Pat. No. 5,673,487).

The plier arm 2 has a core part 14 made of a plastic material or metal that carries a handle shell 16 on its handle section 10. The handle shell 16, as shown in FIG. 7, is pivotally mounted in the vicinity of the pivot joint 7 by a pivot pin including bearing openings 20. The handle shell 16 can pivot open in an outward direction from the core part 14 and, during the pivoting-open operation, provide access to a storage chamber 11 which is associated with the core part 14. In its closed position, the handle shell 16 is latched to the core part by means of latching noses or detent arrangements 29. The handle shell 16 is mounted by the bearing protrusions 20 which are received in the bearing openings 19 of the core part 14.

In order to save material, the core part 14 can include a plurality of hollows and rib-like structures. This construction minimizes the material of the core part, yet increases strength and rigidity of the part.

The chamber 11 corresponds in outline approximately to the trapezoidal configuration of the spare blades 12 which are to be inserted there. In order for it to be possible for the spare blades 12 to be easily removed from the chamber 11, the chamber 11 has a rear through-passage opening 18, so that the chamber 11 is of tunnel-like formation overall. Formed around the through-passage opening 18 is a frame on which the spare blades 12 can be located. An angle key 30 is also inserted in the chamber 11. It has its long leg inserted in an opening of the chamber wall. The short leg is located on the broad surface of the outermost spare blade 12 and prevents the same from dropping out.

The core part 14 of the plier arm 2 engages with the other plier arm 1 through an opening of the other plier arm 1, wherein the opening forms two cheeks 26. Located in that section of the core part 14 that is located between the cheeks 26 are bearing pins 23 of the plier arm 2. The bearing pins 23 can latch into bearing openings 24 of the cheeks 26 of the plier arm 1.

The handle section 9 of the plier arm 1 is covered by the U-shaped handle shell 15. The handle shell 15 is connected to the handle section 9 of the core part 13 of the plier arm 1 by a positive locking means, such as for example latching pins.

The handle shell 15 has an opening which extends in the direction of the narrow side and in which there is inserted a locking device 8, which likewise consists of a plastic material. This locking device 8 can be configured as a slide or as a pivot lever and has a protrusion which can come to rest against a latching shoulder 22 of the other plier arm 2. The latching shoulder 22 is located in a concealed position between the two mutually parallel cheeks 26.

On its operating-end section, the plier arm 1 has an anvil 5. For this purpose, the operating-end section is formed as an anvil carrier 6 in the form of two mutually parallel tongues that receive between them a mounting portion of the anvil 5. The tongues are extensions of the cheeks 26 of the arm 1, which in one embodiment is punched out of sheet metal. The anvil 5 in one embodiment consists of a plastic material.

The locking device 8, which is formed in the illustrated embodiment as a pivot member, has laterally projecting protrusions which are mounted in bearing hollows of the core part 13 of the plier arm. These bearing hollows are covered over by the handle shell 15. The handle shell 15 provides an opening 25 which keeps the locking device 8 in the mounted pivot position. The edges of the opening 25 cover over the bearing extensions or projecting protrusions.

A spring 31 biases the device toward the open position, which is illustrated in FIG. 6. The spring 31 is stressed when the two handle sections 9 and 10 are pressed together. The spring 31 is formed as a leaf spring and is mounted in the U-shaped cavity of the core part 13. The free end of the leaf spring 31 is supported in a recess 30 of the core part 14. In this closed position, the protrusion of the locking device 8 can pass in front of the latching shoulder 22.

The handle section 10, which forms the chamber 11, is the one which is rested in and enclosed by the fingers of the operator's hand when using the device. In order to enhance the grip, the handle section has a hollow or depression 28. This is formed by the handle shell 16. The latter covers over a correspondingly shaped hollow or depression 27 of the core part 14. The handle section 10 has an opening 17 at its free end.

The cutting edge of the blade extends parallel to the direction in which the plier arms extend, or in a plane through which the bearing pin 7 of the two plier arms 1 and 2 passes perpendicularly.

Changes and modifications can be made to the embodiments disclosed without departing the spirit and scope of the invention. These changes and modifications are intended to fall within the scope of the invention. The scope of the invention is therefore intended to be limited only by the scope of the appended claims. Priority documents that pertain to the present invention are hereby incorporated by reference.

We claim as our invention:

1. A device for cutting workpieces, the device comprising:

a first plier arm and a second plier arm pivotally connected at a pivot joint to the first plier arm, each plier arm including a handle section on one corresponding side of the pivot joint and an operating-end section on an opposite corresponding side of the pivot joint, each handl section having a core part and a U-shaped handle shell;

an interchangeable blade carried on an operating-end section of one of the plier arms;

an anvil carried on the operating-end section of the other of the plier arms, wherein by moving the two corresponding handle sections towards one another, the interchangeable blade engages the anvil; and a selectively openable chamber being formed in a core part of one of the plier arms for storing spare interchangeable blades therein, the handle shell of the one plier arm being attached to the core part by a pivot connection so that the chamber is opened by the handle shell being pivoted away from the core part.

2. The device according to claim 1, wherein the pivot connection of the handle shell is disposed in a region of a pivot joint of the two plier arms.

3. The device according to claim 1, wherein the handle shell forms substantially the entire handle section.

4. The device according to claim 1, wherein the chamber has a rear through-passage opening.

5. The device according to claim 1, wherein the chamber accommodates an angle key that is located in front of the spare interchangeable blades and prevents the blades from dropping out of the chamber when the chamber is opened by the handle shell being pivoted away from the core part.

6. The device according to claim 1, wherein the two plier arms are kept in a closed position by a latching means including a locking member that projects out of a narrow-side opening of the second plier arm that can be moved by pivoting against a latching shoulder of the first plier arm.

7. The device according to claim 6, wherein the locking shoulder is disposed in a bearing region of the plier arm, the bearing region being enclosed on both sides by cheeks of the second plier arm.

8. The device according to claim 1, further including a pivoting locking member mounted in a core part of the second plier arm by way of pin extensions and secured in a bearing location by means of a handle shell.

9. A device for cutting workpieces, the device comprising:

a first plier arm and a second plier arm pivotally connected at a pivot joint to the first plier arm, each plier arm including a handle section on one corresponding side of the pivot joint and an operating-end section on an opposite corresponding side of the pivot joint;

an interchangeable blade carried on an operating-end section of one of the plier arms;

an anvil carried on the operating-end section of the other of the plier arms, wherein by moving the two corresponding handle sections towards one another, the interchangeable blade engages the anvil; and a selectively openable chamber formed in on of the plier arms for storing spare interchangeable blades therein, the chamber accommodating an angle key that is located in front of the spare interchangeable blades and prevents the spare interchangeable blades from dropping out of the chamber when the chamber is opened.

10. A device for cutting workpieces, the device comprising:

a first plier arm and a second plier arm pivotally connected at a pivot joint to the first plier arm, each plier arm including a handle section on one corresponding side of the pivot joint and an operating-end section on an opposite corresponding side of the pivot joint, the handle section of the first plier arm having a core part, and a U-shaped handle shell connected to the core part by a pivot connection;

an interchangeable blade carried on an operating-end section of the first plier arm;

an anvil carried on the operating-end section of the second plier arm, wherein by moving the two corresponding handle sections towards one another, the interchangeable blade engages the anvil; and a selectively openable chamber formed in the core part of the first plier arm for storing spare interchangeable blades therein, said chamber being opened by pivoting the handle shell away from the core part and being closed by pivoting the handle shell onto the core part.

11. The device according to claim 10, wherein the pivot connection of the handle shell is disposed in a region of a pivot joint of the two plier arms.

* * * * *